US006824673B1

(12) United States Patent
Ellis et al.

(10) Patent No.: US 6,824,673 B1
(45) Date of Patent: Nov. 30, 2004

(54) PRODUCTION OF LOW SULFUR/LOW AROMATICS DISTILLATES

(75) Inventors: Edward S. Ellis, Basking Ridge, NJ (US); Henry Jung, Mendham, NJ (US); William E. Lewis, Baton Rouge, LA (US); Larry L. Iaccino, Friendswood, TX (US); Michele S. Touvelle, Baton Rouge, LA (US); Gordon F. Stuntz, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/553,374

(22) Filed: Apr. 20, 2000

Related U.S. Application Data

(63) Continuation-in-part of application No. 09/457,434, filed on Dec. 7, 1999.
(60) Provisional application No. 60/111,346, filed on Dec. 8, 1998.

(51) Int. Cl.[7] ..... C10G 45/00
(52) U.S. Cl. ..... 208/58; 208/89; 208/210; 208/216 R; 208/217; 208/15; 585/14
(58) Field of Search ..... 208/89, 59, 210, 208/216 R, 217, 15; 555/14

(56) References Cited

U.S. PATENT DOCUMENTS 4,243,519 A * 1/1981 Schorfheide
5,110,444 A * 5/1992 Haun et al.
5,114,562 A * 5/1992 Haun et al.
5,183,556 A * 2/1993 Reilly et al.
5,292,428 A * 3/1994 Harrison et al.
5,516,342 A * 5/1996 Cherpeck ..... 44/347
5,741,414 A * 4/1998 Waku et al.

* cited by examiner

*Primary Examiner*—Jerry D. Johnson
(74) *Attorney, Agent, or Firm*—Gerard J. Hughes; Jeremy J. Kliebert

(57) ABSTRACT

A process for producing distillate boiling range streams that are low in both sulfur and aromatics. A distillate feedstock is treated in a first hydrodesulfurization stage in the presence of a hydrogen-containing treat gas and a hydrodesulfurization catalyst, thereby resulting in partial desufurization of the stream. The partially desulfurized distillate stream is then treated in a second hydrodesulfurization stage, also in the presence of a hydrogen-containing treat gas and a hydrodesulfurization catalyst. The hydrogen-containing treat gas is cascaded from the next downstream reaction stage, which is an aromatics hydrogenation stage.

17 Claims, 2 Drawing Sheets

PRODUCTION OF LOW SULFUR/LOW AROMATICS DISTILLATES

CROSS REFERENCE TO RELATED APPLICATIONS

This is a Continuation-in-Part of U.S. Ser. No. 09/457,434 filed Dec. 7, 1999, which claims priority from U.S. Provisional Patent Application No. 60/111,346, filed Dec. 8, 1998.

FIELD OF THE INVENTION

The present invention relates to a process for producing distillate boiling range streams that are low in both sulfur and aromatics. A distillate feedstock is treated in a first hydrodesulfurization stage in the presence of a hydrogen-containing treat gas and a hydrodesulfurization catalyst, thereby resulting in partial desufurization of the stream. The partially desulfurized distillate stream is then treated in a second hydrodesulfurization stage, also in the presence of a hydrogen-containing treat gas and a hydrodesulfurization catalyst. The hydrogen-containing treat gas is cascaded from a third, downstream reaction stage, which is an aromatics hydrogenation stage,

BACKGROUND OF THE INVENTION

Environmental and regulatory initiatives are requiring ever lower levels of both sulfur and aromatics in distillate fuels. For example, proposed sulfur limits for distillate fuels to be marketed in the European Union for the year 2005 is 50 wppm or less. There are also proposed limits that would require lower levels of total aromatics as well as lower levels of multi-ring aromatics found in distillate fuels and heavier hydrocarbon products. Further, the maximum allowable total aromatics level for CARB reference diesel and Swedish Class I diesel are 10 and 5 vol. %, respectively. Further, the CARB reference fuels allows no more than 1.4 vol. % polynuclear aromatics (PNAs). Consequently, much work is presently being done in the hydrotreating art because of these proposed regulations.

Hydrotreating, or in the case of sulfur removal, hydrodesulfurization, is well known in the art and typically requires treating the petroleum streams with hydrogen in the presence of a supported catalyst at hydrotreating conditions. The catalyst is usually comprised of a Group VI metal with one or more Group VIII metals as promoters on a refractory support. Hydrotreating catalysts that are particularly suitable for hydrodesulfurization, as well as hydrodenitrogenation, generally contain molybdenum or tungsten as the Group VI metal on alumina support promoted with cobalt, nickel, iron, or a combination thereof as the Group VIII metal. Cobalt promoted molybdenum on alumina catalysts are most widely used when the limiting specifications are hydrodesulfurization, while nickel promoted molybdenum on alumina catalysts are the most widely used for hydrodenitrogenation, partial aromatic saturation, as well as hydrodesulfurization.

Much work is also being done to develop more active catalysts and to improve reaction vessel designs in order to meet the demand for more effective hydroprocessing processes. Various improved hardware configurations have been suggested. One such configuration is a co-current design where feedstock flows downwardly through successive catalyst beds and treat gas, which is typically a hydrogen-containing treat gas, also flows downwardly, co-current with the feedstock. Another configuration is a countercurrent design wherein the feedstock flows downwardly through successive catalyst beds counter to upflowing treat gas, which is typically a hydrogen-containing treat-gas. The downstream catalyst beds, relative to the flow of feed, can contain high performance, but otherwise more sulfur sensitive catalysts because the upflowing treat gas carries away heteroatom components, such as $H_2S$ and $NH_3$, that are deleterious to sulfur and nitrogen sensitive catalysts.

Other process configurations include the use of multiple reaction stages, either in a single reaction vessel, or in separate reaction vessels. More sulfur sensitive catalysts can be used in the downstream stages as the level of heteroatom components becomes successively lower. In this regard, European Patent Application 93200165.4 teaches a two-stage hydrotreating process performed in a single reaction vessel.

Two types of process schemes are commonly employed to achieve substantial hydrodesulfurization (HDS) and aromatics saturation (ASAT) of distillate fuels and both are operated at relatively high pressures. One is a single stage process using Ni/Mo or Ni/W sulfide catalysts operating at pressures in excess of 800 psig. To achieve high levels of saturation, pressures in excess of 2,000 psig are required. The other process scheme is a two stage process in which the feed is first processed over a Co/Mo, Ni/Mo or Ni/W sulfide catalyst at moderate pressure to reduce heteroatom levels while little aromatics saturation is observed. After the first stage, the product stream is stripped to remove $H_2S$, $NH_3$ and light hydrocarbons. The first stage product is then reacted over a Group VIII metal hydrogenation catalyst at elevated pressure to achieve aromatics saturation. Such two stage processes are typically operated between 600 and 1,500 psig.

In light of the above, there is a need for improved desulfurization/aromatic saturation process for treating feedstreams so that they can meet the ever stricter environmental regulations.

SUMMARY OF THE INVENTION

In accordance with the present invention there is provided a multi-stage process for hydrodesulfurizing and hydrogenating a distillate feedstock having a sulfur content greater than about 3,000 wppm, which process comprises:

a) reacting said feedstream in a first hydrodesulfurization stage in the presence of a hydrogen-containing treat gas, said first hydrotreating stage containing one or more reaction zones, each reaction zone operated at hydrodesulfurizing conditions and in the presence of a hydrodesulfurization catalyst, thereby resulting in a liquid product stream having a sulfur content less than about 3,000 wppm;

b) passing the liquid product stream to a first separation zone wherein a vapor phase product stream and a liquid phase product stream are produced;

c) passing the liquid phase product stream to a second hydrodesulfurization stage;

d) reacting said liquid phase product stream in a second hydrodesulfurization stage in the presence of a hydrogen-containing treat gas cascaded from, or partially cascaded from, the next downstream stage herein, said second hydrodesulfurization stage containing one or more reaction zones operated at hydrodesulfurization conditions wherein each reaction zone contains a bed of hydrotreating catalyst, thereby resulting in a liquid product stream having less than about 100 wppm sulfur;

e) passing the liquid product stream from said second hydrodesulfurization stage to a second separation zone wherein a vapor phase stream and a liquid phase stream are produced;

f) collecting said vapor phase stream;

g) passing said liquid phase stream from step e) to an aromatics hydrogenation stage; and h) reacting said liquid phase stream in said aromatics hydrogenation stage in the presence of a hydrogen-containing treat gas, said hydrogenation stage L containing one or more reaction zones operated at aromatics hydrogenation conditions wherein each reaction zone contains a bed of aromatics hydrogenation catalyst, thereby resulting in a liquid product stream having substantially reduced levels of sulfur and aromatics.

In a preferred embodiment of the present invention, the liquid phase stream, before it passes through said aromatics hydrogenation stage is contacted with a vapor to strip dissolved gases from said liquid phase.

In a preferred embodiment of the present invention the hydrogenation stage contains two or more separate temperature zones wherein at least one of said temperature zones is operated at a temperature at least 25° C. cooler than the other zone(s).

In yet another preferred embodiment of the present invention the hydrogenation stage is operated in countercurrent mode wherein treat gas flows upwardly countercurrent to downflowing feedstock.

In another preferred embodiment, the invention further comprises combining at least a portion of the liquid product stream of step (h) with at least one of (i) one or more lubricity aid, (ii) one or more viscosity modifier, (iii) one or more antioxidant, (iv) one or more cetane improver, (v) one or more dispersant, (vi) one or more cold flow improver, (vii) one or more metals deactivator, (viii) one or more corrosion inhibitor, (ix) one or more detergent, and (x) one or more distillate or upgraded distillate.

In another embodiment, the invention is a product made in accordance with the above processes.

BRIEF DESCRIPTION OF THE FIGURES

FIG. 1 also shows hydrogen-containing treat gas being cascaded from the downstream reaction stages to the upstream reaction stages.

DETAILED DESCRIPTION OF THE INVENTION

Feedstreams suitable for being treated to produce the low emissions distillate fuel products are those petroleum based feedstocks boiling in the distillate range and above. Such feeds typically have a boiling range from about 150 to about 400° C., preferably from about 175 to about 370° C. These feedstreams usually contain greater than about 3,000 wppm sulfur. Non-limiting examples of such feedstreams include virgin distillates, light cat cycle oils, light coker oils, etc. It is highly desirable for the refiner to upgrade these types of feedstreams by removing as much of the sulfur as possible, as well as to saturate aromatic compounds.

Figure 1:
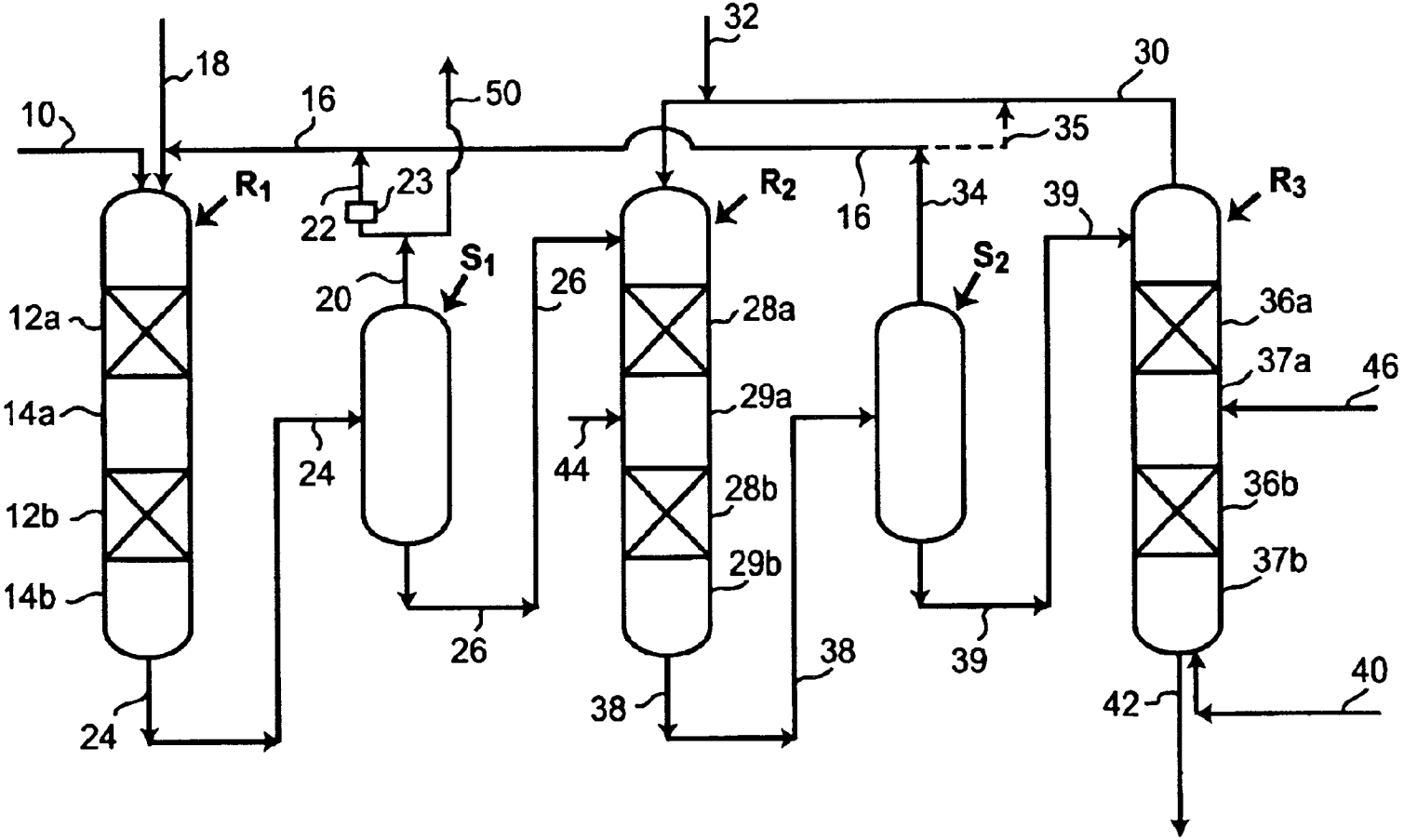
FIG. 1 hereof shows one preferred process scheme for practicing the present invention to produce low emissions distillate fuel compositions. This process scheme shows two hydrodesulfurization stages and one aromatics saturation stage.

The process of the present invention can be better understood by a description of a preferred embodiment illustrated in FIG. 1 hereof. Preferably, the process scheme shown in FIG. 1 hereof uses once-through hydrogen treat gas in at least one of the stages. When either (i) all hydrogen-containing treat gas introduced into a reactor is consumed therein or (ii) unreacted hydrogen-containing treat gas present in a reactor's vapor phase effluent and is conducted away from the reactor, then the treat gas is referred to as a "once-through" treat gas.

Preferably, the first hydrodesulfurization stage will reduce the levels of both sulfur and nitrogen, with sulfur levels being less than about 1,000 wppm, more preferably to less than about 500 wppm. The second hydrodesulfurization stage will reduce sulfur levels to less about 100 wppm. The third stage, the aromatics hydrogenation stage, will saturate a substantial amount of the aromatics and also further reduce sulfur levels to below about 50 wppm. In the practice of this invention, the hydrogen in the treat gas reacts with impurities to convert them to $H_2S$, $NH_3$, and water vapor, which are removed as part of the vapor effluent, and it also saturates olefins and aromatics. Miscellaneous reaction vessel internals, valves, pumps, thermocouples, and heat transfer devices etc. are not shown for simplicity. FIG. 1 shows hydrodesulfurization reaction vessel R1 which contains reaction zones 12*a* and 12*b*, each of which is comprised of a bed of hydrodesulfurization catalyst. While two reactor zones are shown, it will be understood that this reaction stage may contain one reaction zone or alternatively two or more reaction zones. It is preferred that the catalyst be in the reactor as a fixed bed, although other types of catalyst arrangements can be used, such as slurry or ebullating beds. Downstream of each reaction zone is a non-reaction zone, 14*a* and 14*b*. The non-reaction zone is typically void of catalyst, that is, it will be an empty section in the vessel with respect to catalyst. Although not shown, there may also be provided a liquid distribution means upstream of each reaction stage. The type of liquid distribution means is believed not to limit the practice of the present invention, but a tray arrangement is preferred, such as sieve trays, bubble cap trays, or trays with spray nozzles, chimneys, tubes, etc. A vapor-liquid mixing device (not shown) can also be employed in non-reaction zone 14*a* for the purpose of introducing a quench fluid (liquid or vapor) for temperature control.

The feedstream is fed to reaction vessel R1 via line 10 along with a hydrogen-containing treat gas via line 16 that is cascaded from second hydrodesulfurization reaction stage R2. The term "cascaded", when used in connection with a treat gas, means a stream of treat gas is separated from the vapor effluent of a first reaction stage and then conducted to the inlet of a second reaction stage without passing through a compressor. The second reaction stage may be upstream or downstream of the first reaction stage with respect to the liquid flow. In other words, the relative reaction conditions in the first and second reaction stages and associated separation zones are regulated so that the treat gas in the vapor phase effluent from the first stage naturally flows to the second stage, without the need to increase the pressure of the treat gas in the first stage's vapor phase effluent.

Though not required, all or a portion of the hydrogen-containing treat gas may also be conducted to hydrodesulfurization reaction stage R1 via line 18. This additional hydrogen-containing treat gas will typically be cascaded or otherwise obtained from another refinery process unit, such as a naphtha hydrofiner. The vapor effluent from S1 may be (i) recycled via lines 20, 22, and 16, (ii) conducted away from the process via line 50, or (iii) used in a combination of (i) and (ii). The term "recycled" when used herein regarding hydrogen treat gas is meant to indicate a stream of hydrogen-containing treat gas separated as a vapor effluent from one stage that passes through a gas compressor 23 to increase its pressure prior to being sent to the inlet of a reaction stage. It should be noted that the compressor will also generally include a scrubber to remove undesirable species such as $H_2S$ from the hydrogen recycle stream. The feedstream and hydrogen containing treat gas pass, co-currently, through the one or more reaction zones of hydrodesulfurization stage R1 to remove a substantial amount of the heteroatoms, preferably sulfur, from the feedstream. It is preferred that the first hydrodesulfurization stage contain a catalyst comprised of Co—Mo, or Ni—Mo on a refractory support.

The term "hydrodesulfurization" as used herein refers to processes wherein a hydrogen-containing treat gas is used in the presence of a suitable catalyst that is primarily active for the removal of heteroatoms, preferably sulfur, and nitrogen, and for some hydrogenation of aromatics. Suitable hydrodesulfurization catalysts for use in the reaction vessel R1 of the present invention include conventional hydrodesulfurization catalyst such as those that are comprised of at least one Group VIII metal, preferably Fe, Co or Ni, more preferably Co and/or Ni, and most preferably Co; and at least one Group VI metal, preferably Mo or W, more preferably Mo, on a relatively high surface area refractory support material, preferably alumina. Other suitable hydrodesulfurization catalyst supports include refractory oxides such as silica, zeolites, amorphous silica-alumina, and titania-alumina. Additives such as P can also be present. It is within the scope of the present invention that more than one type of hydrodesulfurization catalyst be used in the same reaction vessel and in the same reaction zone. The Group VIII metal is typically present in an amount ranging from about 2 to 20 wt. %, preferably from about 4 to 15%. The Group VI metal will typically be present in an amount ranging from about 5 to 50 wt. %, preferably from about 10 to 40 wt. %, and more preferably from about 20 to 30 wt. %. All metals weight percents are based on the weight of the catalyst. Typical hydrodesulfurization temperatures range from about 200° C. to about 400° C. with a total pressures of about 50 psig to about 3,000 psig, preferably from about 100 psig to about 2,500 psig, and more preferably from about 150 to 500 psig. More preferred hydrogen partial pressures will be from about 50 to 2,000 psig, most preferably from about 75 to 800 psig.

A combined liquid phase/vapor phase product stream exits hydrodesulfurization stage R1 via line 24 and passes to separation zone S1 wherein a liquid phase product stream is separated from a vapor phase product stream. The liquid phase product stream will typically be one that has components boiling in the range from about 150° C. to about 400° C., but will not have an upper boiling range greater than the feedstream. The vapor phase product stream is collected overhead via line 20.

The liquid reaction product from separation zone S1 is passed to hydrodesulfurization stage R2 via line 26 and is passed downwardly through the reaction zones 28*a* and 28*b*. Non-reaction zones are represented by 29*a* and 29*b*.

Hydrogen-containing treat gas is introduced into reaction stage R2 via line 30 that is cascaded from aromatics hydrogenation stage R3 and is passed cocurrent with the feedstock. As discussed, the term "cascaded" means that treat gas flows from a downstream reaction stage, such as the hydrogenation stage, to an upstream stage that is at the same or lower pressure, and thus there is no need for the gas to be compressed. Though not required, all or a portion of the treat gas may be added to R2 via line 32, which additional treat gas may be from another refinery process unit, such as a naphtha hydrofiner. It is preferred that the rate of introduction of hydrogen contained in the treat gas be less than or equal to 3 times the chemical hydrogen consumption of this rate, more preferably less than about 2 times, and most preferably less than about 1.5 times. The feedstream and hydrogen-containing treat gas pass, co-currently, through the one or more reaction zones of hydrodesulfurization stage R2 to remove a substantial amount of remaining sulfur, preferably to a level wherein the feedstream has less than about 50 wppm sulfur, more preferably less than about 25 wppm sulfur.

Suitable hydrodesulfurization catalysts for use in the reaction vessel R2 in the present invention include conventional hydrodesulfurization catalyst such as those described for use in R1. Noble metal catalysts can also be used, preferably the noble metal is selected from Pt and Pd or a combination thereof. Pt, Pd or the combination thereof is typically present in an amount ranging from about 0.5 to 5 wt. %, preferably from about 0.6 to 1 wt. %. Typical hydrodesulfurization temperatures range from about 200° C. to about 400° C. with total pressures of about 50 psig to about 3,000 psig, preferably from about 100 psig to about 2,500 psig, and more preferably from about 150 to 1,500 psig. More preferred hydrogen partial pressures will be from about 50 to 2,000 psig, most preferably from about 75 to 1,000 psig. Preferably, R2 outlet pressures range from about 500 to about 1,000 psig.

The reaction product from a second hydrodesulfurization stage R2 is passed via line 38 to second separation zone S2 wherein a vapor product, containing hydrogen, is recovered overhead and passed to either, or both, of hydrodesulfurization stage R1 via lines 34 and 16, or for recycle via lines 34 and 35. Alternatively, all or a portion of S2's vapor product may be conducted away from the process. The liquid fraction is passed to aromatics hydrogenation stage R3, via line 39 where it flows downward through reaction zones 36*a* and 36*b*. Non-reaction zones, similar to those in R2 and R3, are represented by 37*a* and 37*b*. Prior to being passed downwardly through the reaction zones of R3, said liquid fraction can first be contacted in a stripping zone (not shown) to remove entrapped vapor components from the liquid stream. For example, as the liquid product stream flows through the stripping zone, it is contacted by upflowing hydrogen-containing treat gas under conditions effective for transferring at least a portion of the feed impurities ($H_2S$ and $NH_3$) from the liquid to the vapor. It is preferred that at least about 80%, more preferably at least about 90% of the remaining $H_2S$ and $NH_3$ will be removed from the downflowing liquid stream. The contacting means comprises any known vapor-liquid contacting means, such as rashig rings, berl saddles, wire mesh, ribbon, open honeycomb, gas-liquid contacting trays, such as bubble cap trays and other devices, etc. It is within the scope of this invention that the stripping zone may be part of reaction vessel R3 or it may be a separate vessel. It is to be understood that although the figure hereof shows the hydrogenation stage operated in countercurrent mode wherein treat gas flows countercurrent to the flow of feedstock, it is understood that the hydrogenation stage can be operated in co-current mode as well.

Fresh hydrogen-containing treat gas is introduced into reaction stage R3 via line 40 and is passed in an upward direction counter to the flow of liquid reaction product. The treat gas rate is preferably from about 400 to 1,200 scf/bbl (standard cubic feet per barrel), more preferably from about 500 to 1,000 scf/bbl. The introduction of clean treat gas (gas substantially free of $H_2S$ and $NH_3$) allows reaction stage R3 to be operated more efficiently owing to a reduction in the activity suppression effects on the catalyst exerted by $H_2S$ and $NH_3$ and an increase in $H_2$ partial pressure. This type of multi-stage operation is particularly attractive for very deep removal of sulfur and nitrogen or when a more sensitive catalyst (i.e., hydrocracking, aromatic saturation, etc) is used in the second reactor. Another advantage of the present invention is that the treat gas rate is relatively low compared with more conventional processes. The use of relatively low treat gas rates is primarily due to the use of previously hydrotreated distillate feedstocks. Further efficiencies are gained by not requiring recycle of treat gas. In other words, in one embodiment the treat gas is a once-through treat gas.

The liquid stream and treat gas are passed countercurrent to each other through one or more catalyst beds, or reaction zones, 36*a* and 36*b*. The resulting liquid product stream exits reaction stage R3 via line 42, and a hydrogen-containing vapor product stream exits reaction stage R3 and is cascaded to reaction stage R2 via line 30. The catalyst used in the reaction zones of this second reaction stage can be any suitable aromatics saturation catalyst. Non-limiting examples of aromatics hydrogenation catalysts include nickel, cobalt-molybdenum, nickel-molybdenum, nickel-tungsten, and noble metal containing catalysts. Preferred are the noble metal catalysts. Non-limiting examples of noble metal catalysts include those based on platinum and/or palladium, which is preferably supported on a suitable support material, typically a refractory oxide material such as alumina, silica, alumina-silica, kieselguhr, diatomaceous earth, magnesia, and zirconia. Zeolitic supports can also be used. Such catalysts are typically susceptible to sulfur and nitrogen inhibition or poisoning. The aromatic saturation stage is preferably operated at a temperature from about 40° C. to about 400° C., more preferably from about 200° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 10 V/V/Hr, preferably from about 1 to 5 V/V/Hr.

The figure also shows several options. For example, lines 44 and 46 can carry a quench fluid that may be either a liquid or a gas. Hydrogen is a preferred gas quench fluid and kerosene is a preferred liquid quench fluid.

While the reaction stages used in the practice of the present invention are operated at suitable temperatures and pressures for the desired reaction, they are preferably regulated to provide for treat gas cascading from R2 and R3 to R1, and for once-through treat gas in R2. For example, while typical hydroprocessing temperatures will range from about 20° C. to about 400° C. at pressures from about 50 psig to about 3,000 psig, reaction conditions, particularly reaction pressures, will generally be regulated to provide the desired treat gas flow to minimize or preferably eliminate the need for ancillary pressure regulation equipment, such as compressors.

It is also within the scope of this invention that the hydrogenation stage contain two or more reaction zones operated at different temperatures. That is, at least one of the reaction zones will be operated at a temperature at least 25° C., preferably at least about 50° C. cooler than the other zone(s). It is preferred that the last downstream reaction zone, with respect to the flow of feedstock be the reaction zone that it operated at the cooler temperatures.

For purposes of hydroprocessing and in the context of the present invention, the terms "hydrogen" and "hydrogen-containing treat gas" are synonymous and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the R1 reactor. The treat gas stream introduced into a reaction stage will preferably contain at least about 50 vol. % hydrogen, more preferably at least about 75 vol. % hydrogen, and most preferably at least 95 vol. % hydrogen. In operations in which unreacted hydrogen in the vapor effluent of any particular stage is used for hydroprocessing in any stage, there must be sufficient hydrogen present in the fresh treat gas introduced into that stage, for the vapor effluent of that stage to contain sufficient hydrogen for the subsequent stage or stages. In one embodiment, all or a portion of the hydrogen required for the first stage hydroprocessing (R1) is contained in the second stage vapor effluent fed up into the first stage. The first stage vapor effluent will be cooled to condense and recover the hydrotreated and relatively clean, heavier (e.g., $C_4$+) hydrocarbons.

The liquid phase in the reaction vessels used in the present invention will typically be comprised of primarily the higher boiling point components of the feed. The vapor phase will typically be a mixture of hydrogen-containing treat gas, heteroatom impurities like $H_2S$ and $NH_3$, and vaporized lower-boiling components in the fresh feed, as well as light products of hydroprocessing reactions. If the vapor phase effluent still requires further hydroprocessing, it can be passed to a vapor phase reaction stage containing additional hydroprocessing catalyst and subjected to suitable hydroprocessing conditions for further reaction. Alternatively, the hydrocarbons in the vapor phase products can be condensed via cooling of the vapors, with the resulting condensate liquid being recycled to either of the reaction stages, if necessary. It is also within the scope of the present invention that a feedstock which already contains adequately low levels of heteroatoms be fed directly into the reaction stage for aromatic saturation and/or cracking.

In one embodiment, the liquid phase products of the invention may be combined with other distillate or upgraded distillate. As discussed, the products are compatible with effective amounts of fuel additives such as lubricity aids, cetane improvers, and the like. While a major amount of the product is preferably combined with a minor amount of the additive, the fuel additive may be employed to an extent not impairing the performance of the fuel. While the specific amount(s) of any additive employed will vary depending on the use of the product, the amounts may generally range from 0.05 to 2.0 wt % based on the weight of the product and additive(s), although not limited to this range. The additives can be used either singly or in combination as desired.

As discussed, distillate fuel products that are characterized as having relatively low levels of sulfur and polynuclear aromatics (PNAs) and a relatively high ratio of total aromatics to PNAs may be formed in accordance with such processes. Such distillate fuels may be employed in compression-ignition engines such as diesel engines, particularly so-call "lean-burn" diesel engines. Such fuels are compatible with: compression-ignition engine systems such as automotive diesel systems utilizing (i) sulfur-sensitive NOx conversion exhaust catalysts, (ii) engine exhaust particulate emission reduction technology, including particulate traps, and (iii) combinations of (i) and (ii). Such distillate fuels have moderate levels of total aromatics, reducing the cost of producing cleaner-burning diesel fuel and also reducing $CO_2$ emissions by minimizing the amount of hydrogen consumed in the process.

In one embodiment, the distillate compositions of the present invention contain less than about 50 wppm, preferably less than about 25 wppm, more preferably less than about 10 wppm, and most preferably less than about 5 wppm sulfur. They preferably have a total aromatics content from about 5 to 15 wt. %, more preferably from about 10 to 15 wt. %. The PNA content of the distillate product compositions obtained by the practice of the present invention will be less than about 1.5 wt. %, preferably less than about 1.0 wt. %, and more preferably less than about 0.5 wt. %. The aromatics to PNA ratio will be at least about 11, preferably at least about 14, and more preferably at least about 17. In another embodiment, the aromatics to PNA ratio ranges from 11 to about 50, preferably from 11 to about 30, and more preferably from 11 to about 20.

The term PNA is meant to refer to polynuclear aromatics that are defined as aromatic species having two or more aromatic rings, including alkyl and olefin-substituted derivatives thereof. Naphthalene and phenanthrene are examples of PNAs. The term aromatics is meant to refer species containing one or more aromatic ring, including alkyl and olefin-substituted derivatives thereof. Thus, naphthalene and phenanthrene are also considered aromatics along with benzene, toluene and tetrahydronaphthalene. It is desirable to reduce PNA content of the liquid product stream since PNAs contribute significantly to emissions in diesel engines. However, it is also desirable to minimize hydrogen consumption for economic reasons and to minimize $CO_2$ emissions associated with the manufacture of hydrogen via steam reforming. Thus, the current invention achieves both of these by obtaining a high aromatics to PNA ratio in the liquid product. The fuels made in accordance with the present invention will preferably boil in the range of about 190° C. to 400° C. Fuels of the present invention having a ratio of total aromatics/PNAs >11 can be prepared by blending large amounts of lighter materials which contain single ring aromatics, but few PNAs. The fuels of the present invention are also distinguished from these in that the T10 boiling point is greater than 200° C. and the API gravity is less than 43.

The following examples are presented to illustrate the present invention and not to be taken as limiting the scope of the invention in any way.

EXAMPLES 1–3

A virgin distillate feed containing from about 10,000 to 12,000 wppm sulfur was processed in a commercial hydrodesulfurization unit (first hydrodesulfurization stage) using a reactor containing both conventional commercial $NiMo/Al_2O_3$ (Akzo-Nobel KF842/840) and $CoMo/Al_2O_3$ (Akzo-Nobel KF-752) catalyst under the following typical conditions: 300–350 psig; 150–180 psig outlet $H_2$; 75% $H_2$ treat gas; 500–700 SCF/B treat gas rate; 0.3–0.45 LHSV; 330–350° C.

The liquid product stream from this first hydrodesulfurization stage was used as feedstream to the second hydrodesulfurization stage. The process conditions for this second hydrodesulfurization stage are also shown in the table below. A commercial NiMo catalyst (Criterion C-411 containing 2.6 wt % Ni and 14.3 wt % Mo) was used in all of the runs.

The liquid product stream from this second hydrodesulfurization stage was used as the feed for the aromatics saturation stage. The catalyst used was Syncat-4 from Criterion. The conditions used and feed and product properties are shown in the table below.

Examples 1–3 demonstrate that products with less than 50 ppm S can be produced wherein the of introduction of hydrogen in the treat gas in the second reaction stage is less than or equal to three times the chemical hydrogen consumption. Examples 1–3 also demonstrate that products with 5–15 wt % aromatics can be produced having a ratio of total aromatics to PNAs greater than about 11 and a T10 boiling point greater than 200° C.

| | Example 1 | Example 2 | Example 3 |
|---|---|---|---|
| Process conditions for second HDS stage | | | |
| T, ° C. | 332 | 331 | 342 |
| Pressure, psig | 800 | 800 | 800 |
| LHSV | 1.1 | 1.48 | 1.1 |
| Treat gas rate (100% $H_2$), SCF/B | 510 | 441 | 455 |
| Catalyst | Commercial NiMo | Commercial NiMo | Commercial NiMo |
| Feed properties for second HDS stage | | | |
| S, wppm | 345 | 101 | 238 |
| N, wppm | 73 | 51 | 113 |
| API | 35.9 | 35 | 35.3 |
| T95, ° C. | 367 | 373 | 373 |
| Total aromatics, wt % (HPLC IP 391) | 26.13 | 27.22 | 26.97 |
| 2R + aromatics, wt % (HPLC IP 391) | 6.09 | 7.71 | 7.9 |
| H content, wt % | 13.52 | 13.37 | 13.34 |
| Product properties from second HDS stage (feed to aromatic saturation stage) | | | |
| S, wppm | 33.8 | 19.1 | 33.5 |
| API | 36.6 | 35.8 | 35.4 |
| Total aromatics, wt % (HPLC IP 391) | 23.1 | 28.28 | 24.22 |
| Polynuclear aromatics (PNA), wt % (HPLC IP 391) | 1.97 | 2.59 | 2.05 |
| Total aromatics/PNA | 11.72 | 10.92 | 11.81 |
| $H_2$ consumption, SCF/B | 200 | 175 | 200 |
| Treat gas rate/$H_2$ consumption for second HDS stage | 2.6 | 2.5 | 2.3 |
| Process conditions for aromatic saturation stage | | | |
| T, ° C. | 272 | 267 | 287 |
| Pressure, psig | 800 | 800 | 800 |
| LHSV | 2.74 | 2.03 | 2.75 |
| Treat gas rate (100% $H_2$), SCF/B | 786 | 613 | 621 |
| Product properties from aromatic saturation stage | | | |
| S, wppm | 9.74 | 8 | 8.95 |
| API | 37.9 | 37.1 | 37.6 |
| H content, wt % | 14.12 | 13.94 | 14.02 |
| Total aromatics, wt % (HPLC IP 391) | 8.74 | 14.18 | 10.46 |
| PNA, wt % (HPLC IP 391) | 0.75 | 0.89 | 0.47 |
| Total aromatics/PNA | 11.65 | 15.93 | 22.26 |

COMPARATIVE EXAMPLES A–E

Comparative Examples A–E are all conventional fuels with less than 50 wppm S. Comparative examples A, B, C and D describe fuels that have total aromatics levels greater than 15 wt % and all have a ratio of total aromatics to PNAs less than 10, which is outside the range of this invention.

Comparative example E is a Swedish Class 1 diesel which has a very low total aromatics level of less than 5 wt % and a total aromatics to PNA ratio of greater than 25. Products with less than 5 wt % total aromatics are outside the range of this invention.

| | Comparative Example A | Comparative Example B | Comparative Example C | Comparative Example D | Comparative Example E |
|---|---|---|---|---|---|
| Reference | Executive Order G-714-007 Of the Calif. Air Resources Board | Executive Order G-714-008 Of the Calif. Air Resources Board | As described in Tosco US 5792339 | US 5389111 and US 5389112 | |
| Product properties | | | | | |
| S, wppm | 33 | 42 | <5 | 44 | 8.95 |
| Total aromatics, vol. % (D1319–84; FIA) | 21.7 | 24.7 | | | |
| PNA, wt % (D2425–83; mid-distillate MS) | 4.6 | 4.0 | 1.9 | 2.56 | |
| Total aromatics, wt % (D 5186; SFC) | | | 19.4 | 16 | 4.06 |
| PNA, wt % (D5186; SFC) | | | | | 0.16 |
| Total aromatics/PNA | 4.72 | 6.18 | 10.2 | 6.25 | 25.4 |

Figure 2:
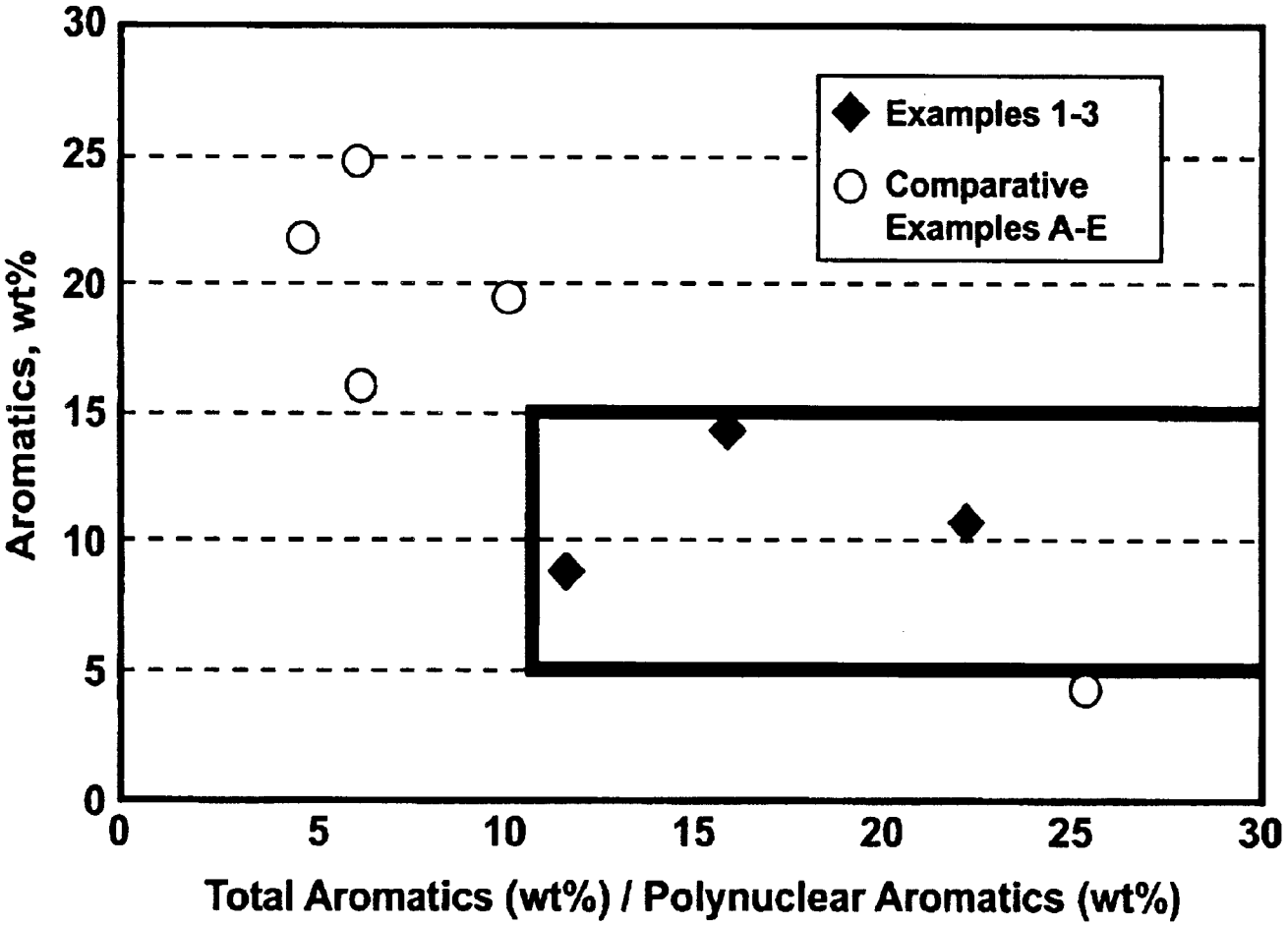
FIG. 2 hereof is a plot of the data relating to some properties of the products produced by the practice of this invention. Total aromatics content is plotted versus the ratio of total aromatics to polynuclear aromatics.

The area inside the box in FIG. 2 defines the products of this invention. The total aromatics/PNA ratio can be greater than 30. Even though FIG. 2's abscissa is truncated at 30 for clarity, it should be understood that the total aromatics/PNA ratio may exceed 30. In addition to the total aromatics (5–15 wt %) and total aromatics/PNA criteria the preferred products of the invention have S levels less than about 50 wppm, a T10 boiling point greater than 200° C., and an API gravity less than 43. The designations "FIA", "MS", and "SFC" are well known in the art as analytical techniques. For example, "FIA" stands for fluorescence indicator analysis, "MS" stands for mass spectrophotometry; and "SFC" stands for supercritical fluid chromatography.

What is claimed is:

1. A multi stage process for hydrodesulfurizing and hydrogenating a distillate feedstock having a sulfur content greater than about 3,000 wppm, which process comprises:

a) reacting said feedstream in a first hydrodesulfurization stage in the presence of a once through hydrogen-containing treat gas, said first hydrodesulfurization stage containing one or more reaction zones, each reaction zone operated at hydrodesulfurizing conditions and in the presence of a hydrodesulfurization catalyst, thereby resulting in a liquid product stream having a sulfur content less than about 3,000 wppm, wherein at least a portion of the hydrogen-containing treat gas for the first hydrodesulfurization zone is supplied from a source other than the present multi-stage process;

b) passing the liquid product stream to a first separation zone wherein a vapor phase product stream and a liquid phase product stream are produced;

c) passing the liquid phase product stream to a second hydrodesulfurization stage;

d) reacting said liquid phase product stream in said second hydrodesulfurization stage in the presence of a hydrogen-containing treat gas cascaded from, or partially cascaded from, the next downstream stage herein, wherein the rate of introduction of the hydrogen portion of the treat gas in this second stage is less than or equal to 1.5 times the chemical hydrogen consumption in this second reaction stage, said second hydrodesulfurization stage containing one or more reaction zones operated at hydrodesulfurization conditions wherein each reaction zone contains a bed of first hydrodesulfurization catalyst, thereby resulting in a liquid product stream having less than about 100 wppm sulfur;

e) passing the liquid product stream from said second hydrodesulfurization stage to a second separation zone wherein a vapor phase stream and a liquid phase stream are produced;

f) collecting said vapor phase stream;

g) passing said liquid phase stream to a stripping stage wherein said liquid phase stream is contacted with countercurrent flowing hydrogen-containing treat gas in the substantial absence of a catalyst thereby producing a stripped liquid phase stream;

h) passing said stripped liquid phase stream from step e) to an aromatics hydrogenation stage;

i) reacting said stripped liquid phase stream in said aromatics hydrogenation stage in the presence of a hydrogen-containing treat gas, said hydrogenation stage containing one or more reaction zones operated at aromatics hydrogenation conditions wherein each reaction zone contains a bed of aromatics hydrogenation catalyst comprising a zeolitic support material, thereby resulting in a liquid product stream having substantially reduced levels of sulfur and aromatics, and a hydrogen-containing vapor product stream that is cascaded to an upstream hydrodesulfurization stage; wherein said aromatics hydrogenation reaction stage contains two or more reaction zones operated at different temperatures wherein at least one of said two or more reaction zones is operated at a temperature at least about 25° C. lower than the other reaction zones; and j) combining the liquid product stream of step (h) with at least one of (i) one or more lubricity aid, (ii) one or more viscosity modifier, (iii) one or more antioxidant, (iv) one or more cetane improver, (v) one or more dispersant, (vi) one or more cold flow improver (vii) one or more metals deactivator, (viii) one or more corrosion inhibitor, (ix) one or more detergent, and (x) one or more distillate or upgraded distillate.

2. The process of claim 1 wherein step d) is performed so that the liquid product stream contains less than about 50 ppm sulfur.

3. The process of claim 2 wherein step d) is performed so that the liquid product steam contains less than about 25 wppm sulfur.

4. The process of claim 1 wherein the catalyst of said first and second hydrodesulfurization stages are selected from catalysts comprised of at least one Group VI and at least one Group VIII metal on an inorganic refractory support.

5. The process of claim 4 wherein the Group VI metal is selected from Mo and W and the Group VIII metal is selected from Ni and Co.

6. The process claim 1 wherein at least a portion of the vapor phase stream from said first separation stage is recycled to said first hydrodesulfurization stage.

7. The process of claim 1 wherein at least a portion of the vapor phase stream from said second separation stage is recycled to said first hydrodesulfurization stage.

8. The process of claim 1 wherein said second hydrodesulfurization stage contains two or more reaction zones operated at different temperatures, wherein at least one of said reaction zones is operated at least about 25° C. lower in temperature than the other reaction zone or zones.

9. The process of claim 8 wherein said second hydrodesulfurization stage contains two or more different reaction zones wherein at least one of said reaction zones is operated at least about 50° C. lower in temperature than the other reaction zone or zones.

10. The process of claim 8 wherein the last downstream reaction zone of said second hydrodesulfurization stage, with respect to the flow of feedstock, is the lower temperature zone.

11. The process of claim 1 wherein said hydrogenation stage contains two or more different reaction zones wherein at least one of said reaction zones is operated at least about 50° C. lower in temperature than the other reaction zone or zones.

12. The process of claim 1 wherein the last downstream reaction zone with respect to the flow of feedstock is the lower temperature reaction zone.

13. The process of claim 1 wherein the hydrogen-containing treat gas and said liquid phase stream of said aromatics hydrogenation stage flow countercurrent to each other.

14. The process of claim 1 wherein the vapor phase stream from the second hydrodesulfurization reaction stage is cooled and the resulting condensed liquid stream is separated from the remaining uncondensed stream, and a portion of the condensed liquid stream is combined with the liquid feed to the aromatics hydrogenation stage.

15. The process of claim 1 wherein the aromatics hydrogenation catalyst is selected from those comprised of a noble metal on an inorganic refractory support.

16. The process of claim 15 wherein the noble metal is selected from Pt or Pd.

17. The process of claim 1 wherein the treat gas provided to the aromatics hydrogenation stage is a once-through treat gas.

* * * * *